US005100057A

United States Patent [19]

Wacker et al.

[11] Patent Number: 5,100,057

[45] Date of Patent: Mar. 31, 1992

[54] ROTARY ATOMIZER WITH ONBOARD COLOR CHANGER AND FLUID PRESSURE REGULATOR

[75] Inventors: Robert L. Wacker, Wellington; Donald E. Shuster, Elyria; Ronald J. Hartle, Amherst, all of Ohio

[73] Assignee: Nordson Corporation, Westlake, Ohio

[21] Appl. No.: 503,310

[22] Filed: Mar. 30, 1990

[51] Int. Cl.[5] ..... B05B 3/10

[52] U.S. Cl. ..... 239/223; 239/305

[58] Field of Search ..... 239/223, 700, 112, 224, 239/305, 701-703

[56] References Cited

U.S. PATENT DOCUMENTS

| | | | |
|---|---|---|---|
| D. 232,830 | 9/1974 | Moos et al | D23/34 |
| 2,893,893 | 7/1959 | Crouse | 117/93 |
| 3,051,394 | 8/1962 | Sedlacsik, Jr. | 239/3 |
| 3,121,024 | 2/1964 | Wampler et al. | 118/2 |
| 3,279,429 | 10/1966 | Felici et al. | 118/627 |
| 3,408,985 | 11/1968 | Sedlacsik, Jr. | 118/629 |
| 3,590,318 | 6/1971 | Probst et al. | 317/3 |
| 3,653,594 | 4/1972 | Bok et al. | 239/112 |
| 3,826,425 | 7/1974 | Scharfenberger et al. | 239/15 |
| 3,870,233 | 3/1975 | Wilhelm et al. | 239/15 |
| 4,011,991 | 3/1977 | Masuda | 239/15 |
| 4,331,299 | 5/1982 | Culbertson et al. | 239/691 |
| 4,337,895 | 7/1982 | Gallen | 239/7 |
| 4,378,091 | 3/1983 | Morishita et al. | 239/703 |
| 4,380,321 | 4/1983 | Culbertson et al. | 239/700 |
| 4,381,079 | 4/1983 | Allen | 239/214.13 |
| 4,405,086 | 9/1983 | Vetter | 239/224 |
| 4,422,576 | 12/1983 | Saito et al. | 239/693 |
| 4,422,577 | 12/1983 | Arnold et al. | 239/703 |
| 4,458,844 | 7/1984 | Mitsui | 239/703 |
| 4,508,271 | 4/1985 | Gress | 239/305 |
| 4,520,949 | 6/1985 | Seitz et al. | 222/108 |
| 4,555,058 | 11/1985 | Weinstein et al. | 239/223 |
| 4,572,437 | 2/1986 | Huber et al. | 239/703 |
| 4,589,597 | 5/1986 | Robisch et al. | 239/703 |
| 4,643,357 | 2/1987 | Culbertson et al. | 239/112 |
| 4,660,771 | 4/1987 | Chabert et al. | 239/694 |
| 4,728,034 | 3/1988 | Matsumura et al. | 239/112 |
| 4,776,520 | 10/1988 | Merritt | 239/223 |
| 4,838,487 | 6/1989 | Schneider | 239/224 |
| 4,887,770 | 12/1989 | Wacker et al. | 239/703 |
| 4,919,333 | 4/1990 | Weinstein | 239/223 |
| 4,927,081 | 5/1990 | Kwok et al. | 239/223 |
| 4,936,510 | 6/1990 | Weinstein | 239/223 |
| 5,014,645 | 5/1991 | Cann et al. | 239/112 X |

FOREIGN PATENT DOCUMENTS

| | | | |
|---|---|---|---|
| 45987/85 | 3/1986 | Australia . | |
| 1202215 | 3/1986 | Canada . | |
| 0120648 | 10/1984 | European Pat. Off. . | |
| 0250942 | 6/1987 | European Pat. Off. . | |
| 2048639 | 4/1972 | Fed. Rep. of Germany . | |
| 3534269 | 4/1987 | Fed. Rep. of Germany | 239/305 |
| 2066701 | 1/1980 | United Kingdom . | |

*Primary Examiner*—Andres Kashnikow
*Assistant Examiner*—Lesley D. Morris
*Attorney, Agent, or Firm*—Wood, Herron & Evans

[57] ABSTRACT

A rotary atomizer for spray coating objects includes an onboard color changer valve manifold as well as an optional onboard fluid pressure regulator. The manifold facilitates rapid and efficient color changing while reducing coating material wastage and solvent usage. The invention also contemplates mounting the color changer repositionally along an axis which preferably coincides with the rotary axis of the atomizer. This facilitates installation and removal of the regulator and permits the coating material flow path between the discharge port of the color changer and the atomizing head to be kept short and straight which improves flow control and facilitates thorough flushing of the flow path with solvent. Other improvements including a particular color changer manifold and atomizer head structure are also disclosed.

40 Claims, 4 Drawing Sheets

ROTARY ATOMIZER WITH ONBOARD COLOR CHANGER AND FLUID PRESSURE REGULATOR

FIELD OF THE INVENTION

The invention relates to a rotary atomizing liquid spray coating apparatus and more particularly to a rotary atomizer including a color changer and an optional fluid pressure regulator both located within the housing of the rotary atomizer.

BACKGROUND OF THE INVENTION

The term "rotary atomizer" refers to a type of liquid spray coating apparatus which includes an atomizer head rotatable at high speed (typically 10,000–40,000 rpm) to effect atomization of a liquid coating material to be applied to a workpiece. The head is usually in the form of a disk or a cup which includes an interior wall defining a cavity and terminating in an atomizing edge. Liquid coating material delivered to the interior of the cup migrates outwardly under centrifugal force along the wall until it is flung from the edge of the cup and thereby atomized. To improve the transfer efficiency of the coating process it is normally desirable to impart an electrostatic charge to the coating material to attract the atomized coating material to an electrically grounded workpiece. An example of an electrostatically charged type rotary atomizer is disclosed in commonly assigned U.S. Pat. No. 4,887,770 to Wacker et al. which is expressly incorporated herein by reference in its entirety. As the foregoing patent also recognizes, transfer efficiency can be further improved by providing a plurality of air jets surrounding the cup to shape the cloud of atomized material and propel it toward the workpiece. In order to facilitate rapid and efficient changing from one color or type of coating material to another, the Wacker et al. '770 patent and the patents discussed below teach providing a valve for selectively flushing the cup and the line which feeds coating material to the cup with solvent in order to clean that line and the cup prior to changing colors or types of coating material.

U.S. Pat. No. 4,422,576 to Saito et al. discloses a color change apparatus and method for an electrostatic rotary atomizer wherein a pair of color change valve manifolds are located remotely from the rotary atomizer. Each manifold includes a plurality of individual color valves whose outlets are connected to a common material feed line as well as valves for selectively delivering paint thinner and air into the feed line for flushing. The inlet of each color valve is connected to a supply of coating material of a particular color. Each of the common feed lines is connected to a first change-over valve mounted to the rotary atomizer in the high voltage region adjacent the rotary atomizing head. The first change-over valve selectively couples one of the feed lines either to the rotary atomizing head or to an inlet of an adjacent change-over valve by way of a first drain line. The second change-over valve includes another inlet connected to a second drain pipe as well as an outlet connected to a third drain pipe. The second drain pipe communicates with a shroud surrounding the atomizing head while the third drain pipe runs to a remotely located ejector valve.

To change from one color to another, solvent is fed at high pressure and at a great flow rate together with bursts of air through: the feed line, the first change-over valve, the first drain pipe, the second change-over valve and finally to the ejector by way of third drain pipe. Then, the change-over valves are shifted to feed solvent to the atomizing head from which it collects in the shroud. The shroud drains via the second drain pipe and through the second change-over valve to the ejector valve by way of the third drain. Prior to introducing the next color of coating material into the feed line, air and thinner under high pressure are flushed through the third drain line by way of the first change-over valve, first drain line and second change-over valve prior to reapplying high voltage to the rotary atomizing head.

This system suffers from the drawback of requiring flushing of the long paint lines between the color changer and the change-over valves. This increases both wastage of coating material and the amount of solvent required to flush the system sufficiently to avoid contaminating the next desired coating material with the color used previously. Rapid and complete flushing is further inhibited owing to the circuitous coating material path which must be flushed. That path is not only long and voluminous but also includes areas of irregular shape and changing cross-section where coating material will tend to accumulate.

U.S Pat. No. 4,380,321 to Culbertson et al. discloses a color change valve structure for a rotary atomizer which includes a coating material valve and a dump valve. Both valves are mounted in a single valve body which is located just behind the rotary atomizing head. The coating material valve includes an inlet which is connected to a feed line carrying either coating material or flushing media from remotely located valves. The dump valve operates to selectively connect the feed line through the material valve to a dump outlet. To purge the system of material of a first color in preparation for spraying material of a different color, the dump valve is opened and a flow of flushing media is established through the supply line to cleanse the supply line and material valve and expel waste through the dump outlet. Thereafter, the dump valve is closed and the material valve is momentarily opened to cleanse that portion of the coating material supply path located between the material valve and the atomizing head to prepare for spraying material of the different color.

While the proximity of the coating and dump valves to the atomizing head in this arrangement reduces the quantity of coating material and flushing media impinging on the spray head during color changing, this system does not eliminate the need to flush a long feed line connected to the material valve from a remotely located color changer. Moreover, like Saito et al. '576 the first and second change-over valves and their interconnections with the atomizing head and with one another define a circuitous flow path which presents many areas in which material can accumulate and which is therefore difficult to flush thoroughly.

Accordingly, there is a need for a rotary atomizer which is capable of spraying a plurality of colors without requiring the flushing of long coating material feed lines between the rotary atomizer and a common coating material feed line for supplying colors one at a time to the atomizer. There is also a need for such a rotary atomizer wherein the portion of the coating material path which must be flushed is kept to a minimal volume and presents few, if any, regions wherein coating material may accumulate in pockets which are difficult to flush thoroughly.

Another drawback of the prior art concerns problems in controlling the flow rate of coating material expelled from the atomizing head. Since flow rate is correlated to pressure, it has been known to connect a fluid pressure regulator in series with the coating material supply line connected to an atomizer. Such regulators have heretofore been mounted outside the housing of the rotary atomizer in series with the coating supply line. Applicants have recognized that this is undesirable for a number of reasons.

First, accurate flow control is facilitated if the pressure adjacent the nozzle supplying coating material to the atomizing head is substantially the same as the pressure at the outlet of the regulator. Locating the regulator exteriorly of the atomizer increases the pressure drop between the regulator and the nozzle supplying coating material to the atomizing head thereby degrading the accuracy of control. Control response time also suffers from such mounting since there can be a significant time lag between a change in pressure at the outlet of the regulator and a corresponding flow change at the outlet of the nozzle which delivers coating material to the atomizing head. These control problems are exacerbated in rotary atomizers such as Saito et al. and Culbertson et al., supra both of which include valving immediately upstream of the atomizing head in the coating material supply path. Such valving increases the length of the mean flow path and gives rise to an even larger pressure drop.

Positioning a pressure regulator remotely from the atomizer causes even further pressure regulation inaccuracy when a rotary atomizer is to be mounted on an oscillator having significant vertical travel. As the atomizer is raised and lowered, the pressure head between the regulator and the nozzle supplying the coating material to the atomizing head will vary as a function of the vertical height of the atomizer. As a result, the atomizer will tend to deliver less coating material when raised as compared to when the atomizer is in a lower position.

While mounting a regulator remotely of the atomizer offers an advantage in that the regulator can be conveniently disconnected when not required for a particular job, such external mounting is bulky and exposes the regulator to overspray and other contaminating build up particularly where the regulator is mounted inside a spray booth.

Accordingly, there is a need for a rotary atomizer which is compact and which includes a fluid pressure regulator mounted for improved flow rate control accuracy and improved response time, irrespective of the vertical position of the rotary atomizer. There further exists a need for a rotary atomizer offering such improved control while protecting the regulator from a contaminating environment and yet permitting the regulator to be conveniently disconnected and reconnected depending on the requirements of a particular coating job.

SUMMARY OF THE INVENTION

The present invention meets the above needs by providing a rotary atomizer having a color changer valve manifold and, just downstream thereof, an optional fluid pressure regulator both located entirely within the housing of the rotary atomizer in close proximity to its atomizing head. The color changer manifold includes a plurality of independently actuatable valves each having an inlet and an outlet. The inlet of one of the valves is connected to a supply of solvent while the remaining inlets are each coupled to a supply of a different color or type of coating material. The outlets of all of the valves, including the one supplied with solvent are connected to a common discharge port which communicates with the rotary atomizing head by way of a coating material flow path. Owing to the onboard mounting of the color changer, that coating material flow path is both short in length and small in volume. Accordingly, coating material is conserved since only a small volume of material must be purged prior to changing to a different color and/or type of material thereby reducing the expense of coating operations. Also, the flow path may be flushed thoroughly with a minimal volume of solvent whereby necessary expenditures for solvent are also reduced. Since both wasted coating material and used solvent can sometimes be toxic, reducing their generation helps to protect the environment and reduces disposal costs.

The invention further contemplates supporting the color changer such that its discharge port lies in substantially direct alignment with all or most of the coating material flow path between the color changer and the atomizing head and which preferably coincides with the axis of rotation of the atomizing head. The invention thereby provides a substantially straight, readily flushable flow path between the color changer and the atomizing head.

The invention further contemplates mounting the color changer to be adjustably positionable along the aforementioned axis. Such mounting provides for easily connecting a pressure regulator between the discharge port of the color changer and the atomizing head. The pressure regulator, which is preferably a type variable by remote control, is mounted in close proximity to the atomizing head so that the outlet pressure of the regulator correlates predictably with the pressure at which the atomizer head is supplied with coating material. Moreover, because the pressure regulator always remains at substantially the same elevation as the atomizing head, even when the atomizer is raised and lowered by an oscillator when in use, flow variations due to changes in the height of the atomizer do not occur.

Further according to the invention, each of the valves in the color changer manifold are mounted in a common body which is preferably of an electrically non-conductive material. The valves are identically constructed to minimize spare parts requirements. Also, the valves are disposed in a radial array within the valve body such that the outlet of each valve lies closely adjacent the common discharge port to even further reduce the length and volume of the portion of the flow path which must be flushed prior to a color change.

The inlet of one of the valves of the color change manifold can be connected to a supply of solvent while the remaining valves each receive a different color or type of coating material. Depending upon which of the valves is selectively opened at a given time, either solvent or coating material of a particular color is delivered to the atomizing head by way of the discharge port. Thus, to change from a first color to a second color, the valve supplying the first color is first closed. The valve receiving a supply of solvent is opened next in order to flush the first color from the paint path between the onboard color changer and the atomizing head. When flushing is completed, the solvent valve is closed and a different valve connected to a supply of material of the second color is opened.

Since one valve is used for solvent, the invention normally provides for selecting among a number of colors equal to one less than the total number of valves in the onboard valve manifold. However, the invention has the flexibility to provide for an even greater number of colors by connecting one of the valves of the onboard color changer to an external color changer.

These and other aspects and advantages of this invention will be more readily apparent from the following description of the drawings wherein like reference numerals designate like items and in which:

DETAILED DESCRIPTION OF THE DRAWINGS

Figure 1:
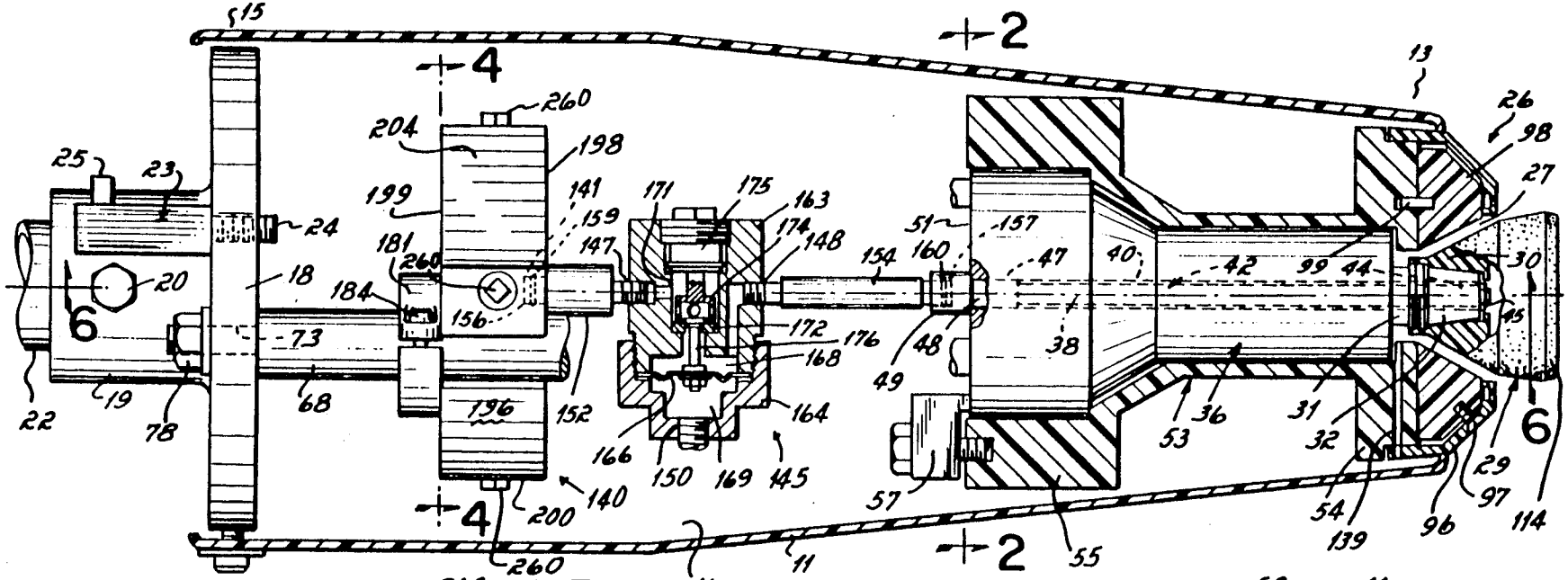
FIG. 1 is a partial longitudinal cross-sectional view of a preferred embodiment of a rotary atomizer constructed in accordance with the principles of the present invention including an on board color changer as well as an optional on board pressure regulator.

Referring initially to FIG. 1, a preferred embodiment of a rotary atomizer 10 constructed in accordance with the present invention is shown. Rotary atomizer 10 includes a generally tubular housing 11 having a forward end 13 and a rearward end 15. Housing is preferably constructed of electrically non-conductive material and defines an interior space 16 which is terminated at rearward end 15 by a support flange 18 which carries a hollow cylindrical extension 19 having locking means such as a bolt 20 for securing rotary atomizer 10 to a support member 22 which may be either fixed or movable. For example, support member 22 may be attached to an oscillator (not shown) for moving rotary atomizer 10 along a predetermined path when it is in use.

The forward end 13 of housing 11 terminates in a cap assembly 26 which will be described in further detail with reference to FIG. 3. For present purposes, it is sufficient to note that cap assembly 26 includes a tapered central recess 27 from which a rotary atomizer head in the form of a cup 29 extends. Cup 29, which will also be described in further detail hereinafter, includes a base 30 which is threadably secured to a shaft 31 having a frusto-conical portion 32. Shaft 31 extends from a motor 36 for rotating cup 29 at high speed about an axis 38. Motor 36 preferably comprises an air driven type turbine which includes internal air bearings, a driving air inlet and a braking air inlet for controlling the rotation of cup 29, all of which components are well known in the art and do not form a part of the invention. Motor 36 also has a bore 40 which is aligned with axis 38 and traverses the entire length of motor 36 and shaft 31. Shaft 31 extends from the rear of motor 36, where it is secured to turbine blades (not shown), out through the front of the motor 36 where the cup 29 is threadably secured thereto as previously described.

A removable coating material feed tube 42 extends through bore 40. Feed tube 42 has a first end 44 which communicates with the interior of cup 29 and which preferably carries a removable nozzle 45 (see FIG. 3). Feed tube 42 further includes an opposed second end 47 having a female fluid coupling 49. Coupling 49 has a base 48 which is frictionally and removably received within the base 51 of motor 36. When engaged within base 51, base 48 supports feed tube 42 in cantilevered fashion free of contact from the wall of bore 40 thereby eliminating the need for a bearing between feed tube 42 and rotating components associated with motor 36.

Figure 2:
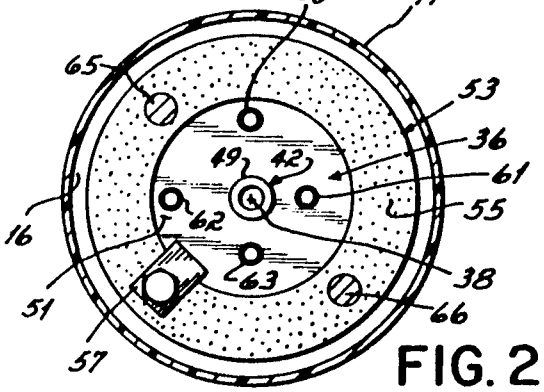
FIG. 2 is an axial cross-sectional view take along line 2—2 of FIG. 1.

As can be better understood with reference now to FIG. 2, motor 36 is received within a motor housing 53 which is preferably formed of an electrically non-conductive material. Motor housing 53 has a forward end 54 secured to cap assembly 26 and a rearward end 55 which carries one or more clamps 57 engageable with the base 51 of motor 36 for holding motor 36 securely in place within motor housing 53 as shown.

With additional reference to FIG. 2, it can be seen that the base 51 of motor 36 includes a driving air inlet 60, a braking air inlet 61, a bearing air inlet 62 and an exhaust port 63, each connected to respective conduits (not shown) extending exteriorly of rotary atomizer 10 through a notch formed in flange 18. The rearward end 55 of motor housing 53 receives threaded ends 65 and 66 of a pair of parallel, spaced supports 67 and 68 only one of which 68, is partially visible in FIG. 1 (see FIG. 6 also). Supports 67 and 68 each extend through the interior space 16 of housing 11 to support flange 18 and are generally perpendicular thereto. The respective second threaded ends 72, 73 of supports 67, 68 extend through flange 18 and are secured relative to flange 18 by means of respective nuts 77 and 78.

Although not essential to the practice of the present invention, the rotary atomizer 10 can be an electrostatic type adapted to impart an electrical charge to liquid coating material just prior to its atomization. Accordingly, rotary atomizer 10 can be supplied with a high voltage by a high voltage cable (not shown) which would supply a high voltage to one or more charging electrodes for imparting a charge to the coating material in the manner described in U.S. Pat. No. 4,887,770, which has previously been incorporated by reference herein.

Cap assembly 26 includes a generally circular cap 98 which mates flush with the forward end 54 of motor housing 53 and is positionally located with respect thereto by means of a pin 99. Cap assembly 26 includes an electrically non-conductive cover 96 which is connected to cap 98 by means of a plurality of flat head screws 97. Cover 96 includes an annular groove 103 intersected by a plurality of small air ports 104 each of which is oriented in a direction generally parallel to rotational axis 38. Groove 103 is connected to an air line (not shown) to provide a plurality of jets discharging from air ports 104 to assist in both shaping the spray of coating material discharged from atomizing edge 114 and propelling the spray toward a workpiece to be coated.

Figure 3:
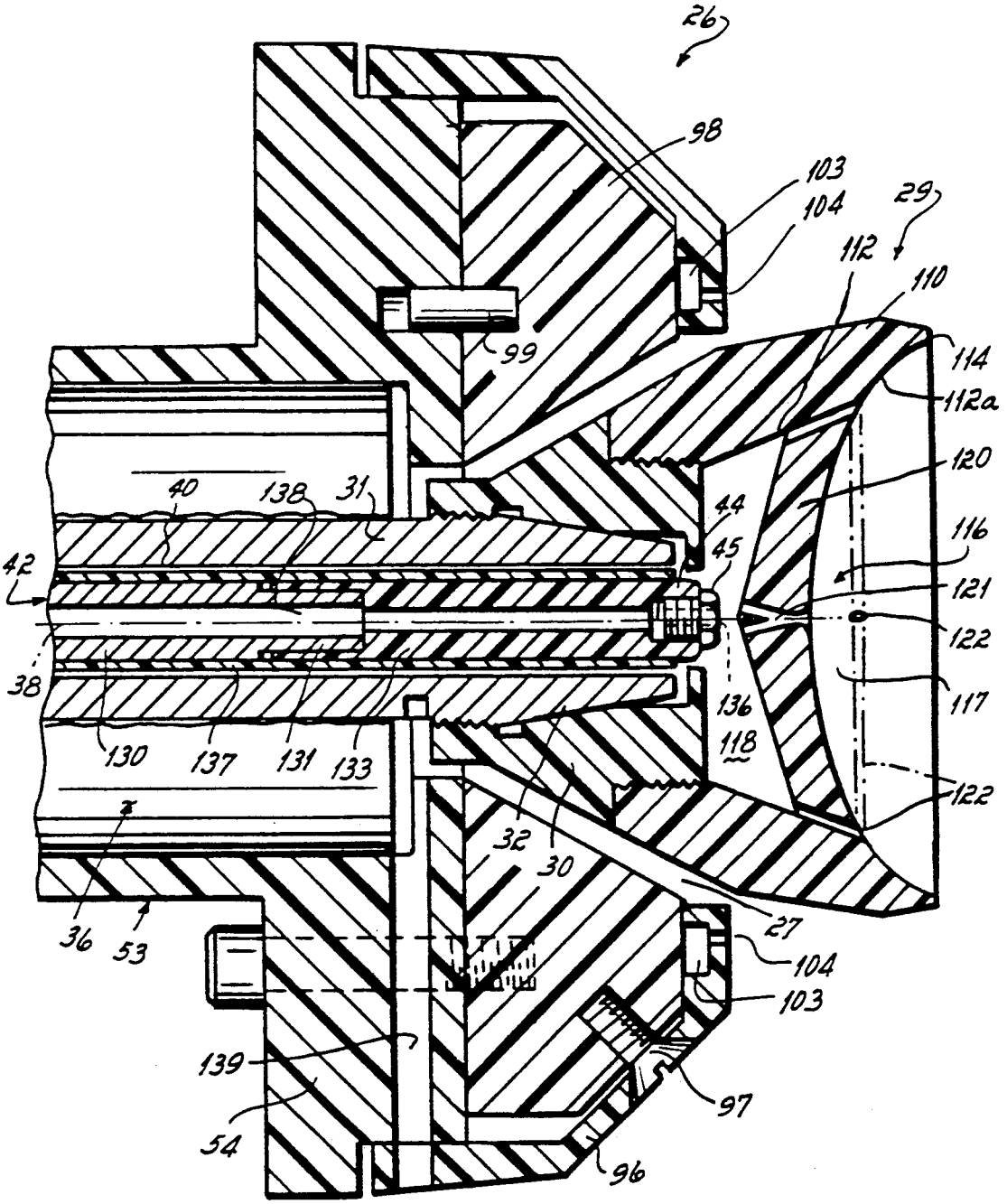
FIG. 3 is a partial longitudinal cross-sectional view showing the forward end of the rotary atomizer of FIG. 1 in further detail.

As FIG. 3 makes clear, the cup 29 in the preferred embodiment is formed of the base portion 30 and an end cap 110. Base 30 is removably threaded to the shaft 31 of motor 36 while end cap 110 is removably threaded to base 30. End cap 110 includes a divider 120 which defines a forward cup cavity 117 and a rearward cup cavity 118. In the illustrated embodiment, divider 120 takes the form of a generally circular disk having a forward face which dishes inwardly toward its central portion. The peripheral portion of divider 120, at its rearward face, adjoins wall 112 and, at its forward face, adjoins a coating material flow surface 112*a* which terminates at an atomizing edge 114.

The periphery of divider 120 includes a plurality of circumferentially spaced holes 122. Holes 12 have inlets adjacent wall 112 and terminate adjacent coating material flow surface 112*a* thereby establishing flow paths through which most of the fluid entering rear cavity 118 makes its way to the coating material flow surface 112*a* which partially surrounds forward cup cavity 118. Also, the central portion of divider 120 is provided with a central opening 121 through which rearward cavity 118 can communicate with forward cavity 117. Preferably, opening 121 is formed of four separate, circumferentially spaced holes which intersect near the forward face of divider 120 but which diverge away from axis 38 so that coating material discharged from nozzle 45 is not aimed directly into opening 121. Nevertheless, when atomizer 10 is in use, some coating material flows through passage 121 and flows along the forward face of divider 120 to keep that surface wetted rather than permitting any back spray which might otherwise accumulate thereon to dry. Between color changes, solvent is introduced through material feed tube 42 and flows through passage 121 as well as along wall 112 and through holes 122 to clean them as well as coating material flow surface 112*a* of the previous color. The solvent which flows through passage 121 cleans the exterior surface of divider 120. That flushing operation is facilitated by keeping the surface of divider 120 wet since wet coating material is more readily dissolved than dried material.

As FIG. 3 further illustrates, removable feed tube 42 comprises a first tube 130 having a reduced diameter end portion 131 which is adhesively bonded inside a recess formed inside a short second portion 133. Second portion 133 threadably receives a nozzle 45 having a central orifice 136 which communicates with the interior passageway 138 of removable feed tube 42. Depending upon the requirements of a particular coating job, the size of central orifice 136 and/or interior passageway 138 can be varied by replacing nozzle 45 and/or feed tube 42 with ones having a central orifice 136 or interior passageway 138 respectively of a different size or diameter to provide desired flow characteristics.

Preferably, the first portion 130 of feed tube 42 is constructed of a rigid material such as stainless steel capable of being supported in cantilevered fashion as described earlier while the second portion 13 of feed tube 44 is preferably an electrically non-conductive material. Portions 130 and 133 of feed tube 42 are preferably covered with a layer of heat-shrinkable tubing 137.

Referring back now to FIG. 1, the rotary atomizer 10 of the invention includes a color change valve manifold 140 as well as an optional fluid pressure regulator 145. Manifold 140 includes a discharge port 141 which can be connected to a fluid inlet 147 of regulator 145. Regulator 145 also includes a fluid outlet 148 and a control air inlet 150. The inlet 147 of regulator 145 receives a threaded end of a first rigid conduit 152 while its fluid outlet 148 receives a threaded end of a second rigid conduit 154. To facilitate connection and disconnection of fluid regulator 145 to discharge port 141 and coupling 49, conduits 152 and 154 each include respective reduced diameter portions 156 and 157 opposite, their threaded ends. Portions 156 and 157 each have a groove with a respective O-ring 159, 160 mounted therein. Reduced diameter portion 156 with its O-ring 159 fits snugly inside the wall of discharge port 141 in order to effect a fluid tight connection between discharge port 141 and first conduit 152. The reduced diameter portion 157 associated With second conduit 154 with its O-ring 160 likewise affects a snug and fluid tight connection with the female coupling 49 of removable feed tube 42.

With continued reference to FIG. 1, fluid pressure regulator 145 is preferably a remotely variable type and, in the preferred embodiment includes an upper housing 163 which threadably connects to a lower housing 164. A flexible diaphragm 166 is captured between upper housing 163 and lower housing 164 to define an upper cavity 168 above diaphragm 166 and a lower cavity 169 below diaphragm 166. Lower cavity 169 communicates with control air inlet 150 which is connected via an air line means (not shown) to a source of control air located remotely from rotary atomizer 10. Upper housing 163 is traversed by a bore 171 which includes a land which supports a valve seat 172. Seat 172 is clamped in place by means of a radially ported, inverted cupshaped member 174 which extends downwardly from a threaded plug 175 fitted within the upper end of bore 171 as illustrated. A movable valve stem 176 having a shape matable with valve seat 172 is mechanically connected to diaphragm 166. Fluid inlet 147 communicates with bore 171 and with the region above valve stem 176 by way of ported member 174. On the other hand, the region beneath valve seat 172 including upper cavity 168 communicates with fluid outlet 148. Regulator 145 operates by limiting the passage of fluid from inlet 147 to outlet 148 past valve seat 172 as a function of the control air pressure applied to lower cavity 169 by way of inlet 150.

Pressure regulator 145 is supported between motor 36 and manifold 140 by conduits 152 and 154. Withdrawal of those conduits from either the female coupling 49 provided at the second end of removable feed tube 42 on one hand or from discharge port 141 on the other hand is prevented by locking regulator 145 and conduits 152 and 154 in place between female coupling 49 and the discharge port 141 of manifold 140. This is facilitated by means of a pair of releasable clamps 180 and 181 which are slidably mounted upon supports 67 and 68, respectively. Each clamp 180, 181 can be locked in place by bolts 183 and 184 to prevent rearward movement of manifold 140 and compress manifold 140 against conduit 152, which in turn, through regulator 145, compresses conduit 154 against coupling 49, thus preventing withdrawal of rigid conduits 152 and 153 from discharge port 141 or coupling 49, respectively.

Figure 4:
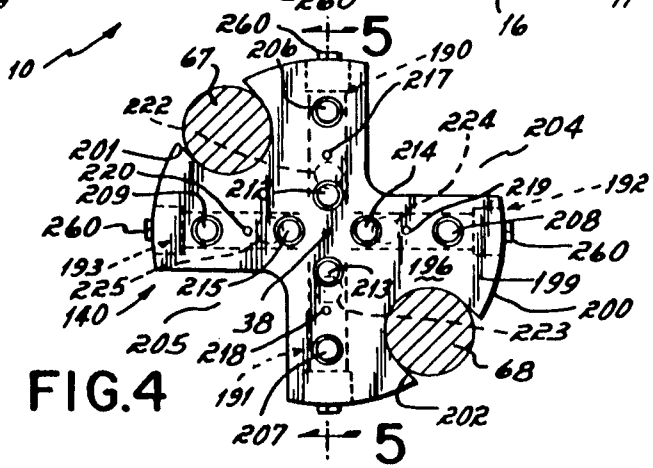
FIG. 4 is an axial view of the color changer and its support taken along line 4—4 of FIG. 1.
Figure 5:
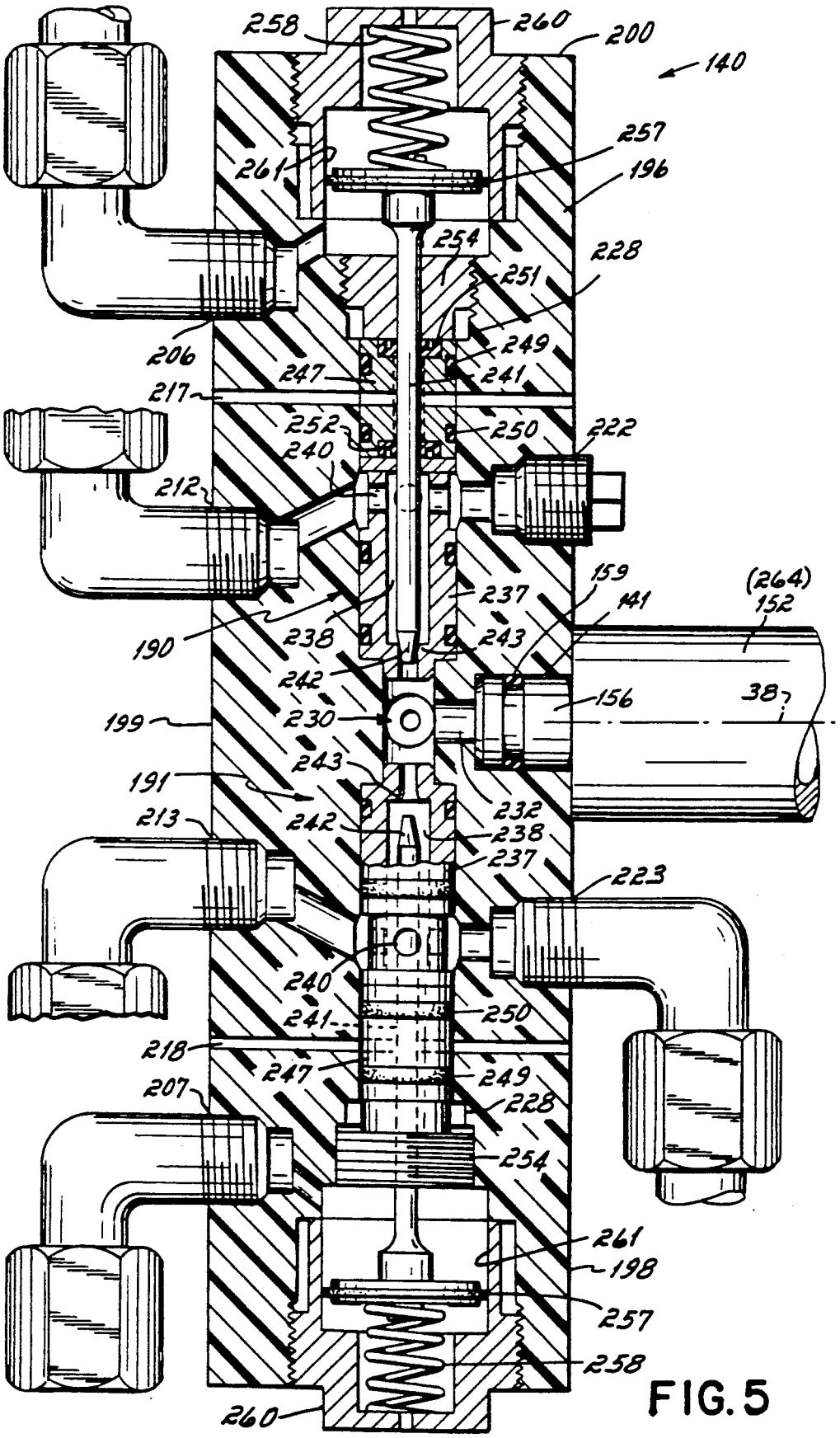
FIG. 5 is a cross-sectional view of a preferred embodiment of a color changer constructed in accordance with the principles of the present invention taken along line 5—5 of FIG. 4.

With reference now to FIGS. 4 and 5 the structure and operation of color change manifold 140 will now be explained. As FIG. 4 illustrates, the manifold 140 includes four valves 190, 191, 192 and 193 disposed in a radial array within a common valve body 196. While the manifold 140 illustrated includes four valves, those skilled in the art will appreciate that the number of valves can be increased as space constraints permit. In accordance with a particular aspect of the invention in electrostatic systems, body 196 can be formed of an electrically non-conducting material to avoid the storage of a capacitive charge.

With additional reference now to FIG. 5, body 196 includes a first, forwardly directed face 198 which is penetrated by discharge port 141 and a mutually opposed second, rearwardly directed face 199. Faces 198 and 199 are separated by a mutually adjoining generally circular peripheral side 200 as shown in FIG. 4. Valve body 196 includes a pair of diametrically opposed guide recesses 201 and 202 shown in FIG. 4 which are spaced apart from one another by a distance corresponding to the spacing between supports 67 and 68. Recesses 201 and 202 have a shape complimentary to the profile of supports 67 and 68 (i.e., circular in the illustrated embodiment) as to be slidably matable therewith. Thus, by releasing the bolts 183 and 184 of clamping rings 180 and 181, respectively, valve manifold 140 can be selectively positioned at any desired axial location along supports 67 and 68 while at all times maintaining discharge port 141 in direct axial alignment with rotary axis 38. Maintaining discharge port 141 in such axial alignment facilitates connection and disconnection of pressure regulator 145 and its associated conduits 152 and 154 as described above. Moreover, thorough flushing of the material coating path between discharge port 141 and cup 29 is facilitated by maintaining discharge port 141, conduit 152, inlet 147, outlet 148, conduit 154 and feed tube 42 all in substantially direct axial alignment with one another and preferably in alignment with axis 38. Such configuration provides the straightest possible flow path for both coating material and solvent particularly in the FIG. 6 embodiment, thereby keeping to an absolute minimum any areas where flow must change direction and where coating material might accumulate. Such a substantially straight path also minimizes the volume of the flow path between discharge port 141 and cup 29 thereby reducing the volume of unusable coating material which must be purged prior to color changing and further reducing the volume of solvent which must be used to purge that flow path. This not only produces cost savings by reducing waste of coating material and reducing solvent usage, but further serves to reduce cost and protect the environment by reducing the volume of wasted coating material and used solvent which must be properly disposed of.

Body 196 also includes a pair of diametrically opposed notches 204 and 205 (see FIG. 4). These notches provide clearance for passage of an electrostatic cable (not shown) or fluid or air conduits. They also provide access openings to facilitate insertion and removal of feed tube 42 and regulator 145. The rearward face 199 of valve body 196 is also penetrated by actuating air inlets 206, 207, 208 and 209 as well as respective fluid inlets 212, 213, 214 and 215 for each respective valve 190, 191, 192 and 193. Each valve 190–193 also includes respective weep holes 217, 218, 219 and 220 which indicate coating material leakage, and isolate the coating material from the valve actuating air to prevent contamination of the air supply system by the coating material. They also prevent air and contaminants from migrating from the air supply system into the coating material passing through manifold 140. Each of the valves 190–193 located within valve body 196 is of an identical construction which will now be described with reference to FIG. 5.

FIG. 5 shows valve 190 in a closed position and valve 191 in an open position. Since valves 190–193 are of identical construction, only one valve, such as valve 190 need be described in detail to complete the description of operation of color changer manifold 140. As noted above, valve 190 includes an actuating air inlet 206 and a fluid inlet 212 each of which enter valve body 196 from its rearward face 199. Valve 190 further includes a fluid recirculation outlet 222 which penetrates valve body 196 from the forward face 198 thereof. As noted previously, face 198 is also penetrated by common discharge port 141 which receives the reduced diameter portion 156 of conduit 152. A multiply-stepped bore 228 penetrates body 196 from its peripheral side 200. Bore 228 is formed along an axis directed radially inwardly toward a common chamber 230 which discharge port 141 communicates with via a passage 232. A member 237 is disposed within the lower portion of bore 228. Member 237 includes an interior fluid passage 238 which communicates with both fluid inlet 212 and fluid recirculation outlet 222 through a plurality of radially directed ports 240 formed in the upper portion of the wall of member 237. Fluid passage 238 receives a movable valve stem 241 having a tapered end portion 242 matable with a valve seat 243 formed inside member 237 at the lower end of passage 238. Movement of valve stem 241 toward and away from valve seat 243 is effective to open and close valve 190.

Member 237 is held in place by a packing gland 247 which includes a pair of spaced O-rings 249 and 250 to effect a fluid-tight seal between the exterior of gland 247 and the wall of bore 228. Additionally, gland 247 includes a pair of cup seals 251 and 252 for effecting a fluid-tight seal between the upper portion of passage 238 and the exterior of valve stem 241. As illustrated, the region of packing gland 247 between O-ring 249 and O-ring 250 communicates with pressure weep hole 217 to ensure effective operation of seals 251 and 252. The packing gland is itself retained by a gland nut 254 which threadably engages an intermediate portion of the wall of bore 228.

The end of valve stem 241 opposite its tapered portion 242 is connected to a piston 257 which is biased by a spring 258 to hold valve 190 in a normally closed position as shown. Spring 258 is retained within the upper end of bore 228 by means of a threaded nut 260 having a cylindrical wall 261 defining a cylinder within which piston 257 travels. The underside of piston 257 communicates with air inlet 206.

When a control signal in the form of sufficient air pressure is supplied to actuating air inlet 206, piston 257 is urged upwardly against the force of spring 258, thereby moving the tapered portion 242 of valve stem 241 away from seat 243 to open valve 190.

When valve 190 is open, fluid entering inlet 212 flows through passage 238 past valve seat 243 to a common chamber 230 which communicates with discharge port 141 and thus, conduit 152 by way of passage 232. On the other hand, when the air pressure applied to inlet 206 is reduced to a level insufficient to overcome spring 258, piston 257 moves downwardly so that the tapered portion 242 of valve stem 241 engages seat 243. Valve 190 is thereby closed, blocking the flow of fluid between fluid inlet 212 and discharge port 141. In that event, fluid entering inlet 212 flows via ports 240 to recirculation outlet 222 from which it is conducted via a conduit which returns unused coating material to its supply (not shown) or to other collection means located remotely from rotary atomizer 10.

Figure 6:
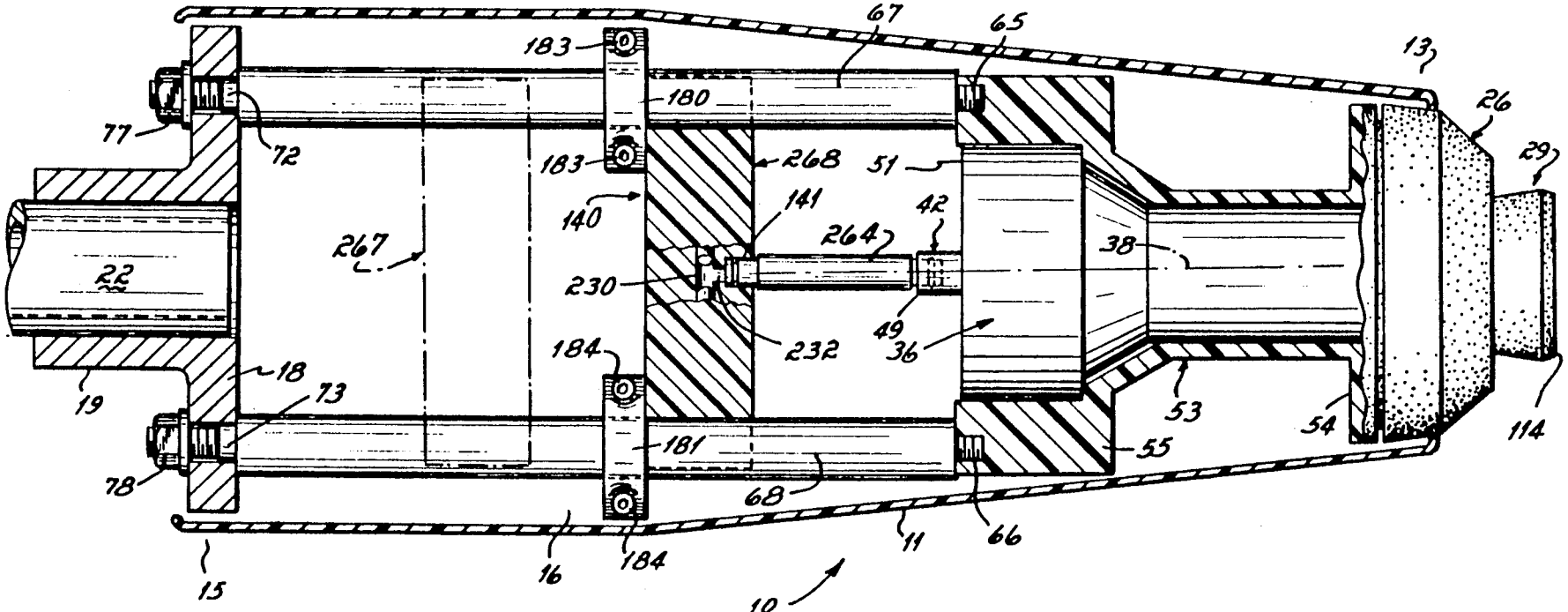
FIG. 6 is a simplified longitudinal view of the rotary atomizer of FIG. 1, partly in cross-section as viewed along line 6—6 of FIG. 1 except having the fluid pressure regulator shown in FIG. 1 removed and having the color changer of FIG. 1 axially repositioned to a more forward position.

With additional reference now to FIG. 6, it can be seen that supports 67 and 68 upon which color change manifold 140 is mounted within the interior space 16 of housing 11 extend between flange 18 and the rearward end 55 of motor housing 53 as already described. Supports 67 and 68 are mounted parallel with one another and with axis 38. Since discharge port 141 is also centered with respect to axis 38, it can be appreciated that color changer manifold 141 can be selectively repositioned along axis 38. For example, the fluid regulator 145 and its associated conduits 152 and 154 shown in FIG. 1 can be removed and, as illustrated in FIG. 6, replaced with a short conduit 264 having frictionally securable O-ring connections of the type described previously on both ends.

To remove regulator 145, clamping rings 180 and 181 are initially released by loosening hex bolts 183 and 184. Manifold 140 is then slid rearwardly from the position 267 (which corresponds to the position of manifold 140 illustrated in FIG. 1) by a distance sufficient to permit withdrawal of conduits 152 and 154 from discharge outlet 141 and female coupling 49, respectively.

Once conduit 154 is disconnected from female coupling 49, removable feed tube 42 may conveniently be withdrawn from bore 40 whereupon it may be cleaned or replaced with another feed tube having a different internal diameter. Thereafter, regulator 145 and its associated conduits 152 and 154 can be reinstalled in the positions shown in FIG. 1. Alternatively, regulator 145 and conduits 152 and 154 can be removed from the interior 16 of housing 11 and replaced with conduit 264 which conveniently plugs into female coupling 49. To couple the opposite end of conduit 264 with outlet 141, color changer 141 is slid forwardly along supports 67 and 68 to the position 268 shown in FIG. 6. Clamps 180 and 181 are then moved along supports 67 and 68 into close abutment with manifold 140 and then tightened to hold manifold 140 as well as conduit 264 and feed tube 42 securely in place.

To prepare rotary atomizer 10 for spraying for example three colors or types of coating material, a pressurized supply of each material is coupled to three of the fluid inlets of manifold 140 such as inlets 213, 214 and 215. The remaining fluid inlet 212 is then coupled to a pressurized source of solvent material (not shown). The recirculation outlet 222 associated with the valve 190 is plugged while the remaining recirculation outlets 223, 224 and 225 are connected via conduit means (not shown) back to the appropriate container from which each material is supplied. Of course, where recirculation of coating material is not desired, each recirculation outlet 222–225 can be plugged. The connections to manifold 140 are completed by connecting each respective actuating air inlet 206, 207, 208 and 209 to air supplies (not shown) which can be selectively pressurized to operate each valve 190–193 independently. Appropriate air supplies are also connected to motor 33 at inlets 60, 61 and 62 to supply motor 36 with driving air, braking air and bearing air, respectively.

The internal diameter of feed tube 42 as well as the size of the opening in nozzle 45 are selected in accordance with the needs of a particular coating job. For example, where the coating material to be sprayed is viscous and/or where larger volume flow rates are desired, feed tube 42 is preferably selected to be one having a larger diameter internal passage and nozzle 45 is selected to be one having a larger orifice. Conversely, where the liquid coating material is of a thin consistency and/or lower volume flow rates are desired a feed tube 42 and nozzle 45 having smaller diameter passages can be selected.

Where it is desired to use a fluid pressure regulator to regulate the flow rate of coating material, fluid pressure regulator 145 is mounted between discharge port 141 and fluid coupling 49 in the manner previously described with reference to FIG. 1. On the other hand, if the use of a fluid pressure regulator is not desired, fluid pressure regulator 145 and its associated conduits 152 and 154 are removed and replaced with conduit 264 as illustrated in FIG. 6. To connect conduit 264 between coupling 49 and the discharge port 141 of manifold 140, manifold 140 is axially repositioned from its original position 267 to its more forward position 268 and locked in place by securing clamping rings 180 and 181 in place on supports 67 and 68 in abutment with the rear of manifold 140 as illustrated in FIG. 6.

Assuming that a regulator 145 is to be installed as illustrated in FIG. 1, a supply of control air is connected to its control air inlet 150. Finally, a suitable supply of pressurized air is applied to the annular groove 103 formed in cover 96 to provide a plurality of air jets which are expelled from the air ports 104 which surround cup 29. With the foregoing connections having been made and with the electrostatic cable (not shown) energized when appropriate in electrostatic systems, and finally with the rotary atomizer securely mounted on a suitable support 22 and positioned opposite a workpiece to be coated spraying operations can be commenced.

In operation, cup 29 is rotated at high speed in accordance with the air pressure supplied to driving air inlet 60 and braking air inlet 61. To commence spraying of the fluid material applied for example to the inlet 213 of valve 191, actuating air is delivered at sufficiently high pressure to inlet 207 to cause valve 191 to open and deliver the coating material applied to inlet 213 to discharge port 141 in a manner completely analogous to the operation of valve 190 described earlier with reference to FIG. 5. Fluid material flows from discharge port 141 through conduit 152 to the inlet 147 of regulator 145 and through ported member 174 to the area above valve stem 176. Depending on the size of the gap between valve seat 172 and valve stem 176, fluid will flow at a controlled rate into upper cavity 168 and into conduit 154 by way of outlet 148. The pressure at outlet 148 will depend on the gap between valve stem 176 and valve seat 172 which in turn will depend on the pressure differential between cavity 168 and lower cavity 169 which are separated by diaphragm 166. In the event a greater or lesser flow of coating material is desired the pressure at outlet 148 can be increased or decreased from a control location remote from atomizer 10 by increasing or decreasing, respectively, the pressure of the control air signal applied to the control inlet 150 of regulator 145.

From the outlet 148 of regulator 145, liquid material flows in a straight path through conduit 154 into feed tube 42 by way of coupling 49 and from the feed tube 42 into the rear cavity 118 of cup 29 by way of nozzle 45. Because the flow path between outlet 148 and cup 29 is short and straight the pressure of the fluid at the inlet of nozzle 45 will correlate accurately and predictably with the pressure at the outlet 148 of regulator 145 thereby facilitating very accurate control over fluid pressure.

Moreover, due to the shortness of the aforementioned flow path, the time response of the fluid pressure control is greatly improved. When the pressure of the control signal applied to the control inlet 150 of 145 changes, that change will be followed very closely in time by a corresponding change in the pressure at nozzle 45. Accordingly, the invention facilitates control over coating material flow rates with better accuracy and faster response times than have heretofore been known.

Once inside the rear cavity 118, some liquid coating material will flow through the opening 121 provided in divider 120 thereby maintaining the forward surface of divider 120 in a wetted condition. This helps prevent clogging caused by dried coating material and facilitates rapid and thorough cleaning when cup 29 is subsequently flushed with solvent. The majority of the coating material, however, is forced along wall 112 due to centrifugal force and caused to migrate along wall 112 outwardly through holes 121 into the forward cup cavity 116. As the coating material flows across the flow surface 112*a* of cup cavity 116 just prior to being expelled from atomizing edge 114 to effect atomization, an electrostatic charge can be imparted to the coating material in the manner shown in U.S. Pat. No. 4,887,770 which has earlier been incorporated by reference herein. The cloud of charged coating material droplets thereby produced is then propelled forwardly toward a workpiece by the action of the air jets emanating from the ports 104 surrounding cup 29.

To change to a different color or type of coating material, spraying of the first material is stopped by closing valve 191. However, prior to opening either valve 192 or 193 to commence flow of a different color or type of coating material from the discharge port 141 of manifold 140 to cup 29 in the manner just described, the first coating material must be purged from the flow path between discharge port 141 and cup 29. To do so, valve 191 is closed and subsequently, valve 190 is opened. Solvent is introduced under pressure into inlet 212 thereby initiating a flow of solvent from outlet 141 through first conduit 152, pressure regulator 145, second conduit 154, feed tube 42 and cup 29. Some of the solvent will flow through passages 121 formed in divider 120 to cleanse the exterior surface of divider 120 of the first coating material while the majority of the solvent will flow along wall 112 through passages 122 and outwardly over coating material flow surface 112*a*. Once the first coating material has been sufficiently flushed, the flow of solvent is stopped. Spraying of a second desired color or type of coating material is then commenced by opening the appropriate valve, e.g., valve 192 to which that material is supplied.

While valve 193 can readily be supplied with a third color or type of liquid coating material the spraying of which can be carried out in the manner described above, the invention provides the flexibility to spray an even greater number of colors by connecting the inlet of, for example valve 193, to a paint feed pipe emanating from a conventional color change valve mechanism of the type described for example in U.S. Pat. No. 4,422,576 to Saito et al. which is expressly incorporated herein by reference. In that event, the outlet 225 normally used for purposes of recirculation is connected by way of a length of tubing to the inlet 24 of dump valve 23 whose outlet 25 may suitably be connected to a drain line or waste receptacle. To change from spraying a first color supplied from the remote color changer to a second color also supplied from the remote valve assembly, valve 193 is closed and dump valve 23 is opened. Thereafter, solvent is introduced into inlet 215 by way of the remote feed line in order to purge and flush the feed line through dump valve 23 by way of outlet 225. Once the feed line has been sufficiently flushed, valve 193 is opened just long enough to permit a flow of solvent to sufficiently flush the flow path between discharge port 141 and cup 29. If the next desired color or type of coating material is to be supplied from the remote valve assembly, valve 193 is opened and the next material is introduced into manifold 140 by way of the feed line from the remote valve assembly. Otherwise, valve 193 is closed and the next color or type of material to be sprayed is selected by actuating either valve 191 or 192.

Having described preferred embodiments of the invention, it will be appreciated that the invention is applicable to electrostatic and non-electrostatic rotary atomizers and both to electrostatic rotary atomizers made of conductive or non-conductive materials. Moreover, while the embodiments described above illustrate the invention, it is to be understood that the invention is not limited to those particular forms. In light of the present disclosure, those skilled in the art will recognize various changes which can be made without departing from the legal scope of the invention which includes not only the subject matter particularly pointed out and distinctly claimed in each of the appended claims, but also all legal equivalents thereof.

What is claimed is:

1. A rotary atomizer, comprising:

(a) a housing having a forward end and a rearward end, said housing defining an interior space between said ends;

(b) an atomizing head rotatable about an axis, said atomizing head having a coating material flow surface forming a forward cavity, said flow surface terminating in an atomizing edge;

(c) supply means for supplying fluid to said forward cavity, said supply means including a feed tube having a first end in fluid communication with said forward cavity and a second end, and (d) a color changer including a discharge port for selectively delivering one of a plurality of fluids to said forward cavity of said atomizing head by way of said feed tube, said color changer including a body in which a plurality of valves are at least partially mounted, each of said valves having at least a fluid inlet and a fluid outlet, each said fluid outlet communicating with a common chamber, said color changer being located entirely within said housing, each said fluid inlet being connectable to a supply of one of said fluids, said common chamber being in fluid communication with said second end of said feed tube by way of said discharge port.

2. The rotary atomizer of claim 1 wherein said common chamber and said tube each lie in substantially direct alignment with said axis.

3. The rotary atomizer of claim 2 wherein said atomizing head further includes a rearward cavity and a divider which separates said forward cavity from said rearward cavity, said divider having a central portion and a periphery and paint flow passages through said central portion and through said periphery, and wherein said feed tube supplies fluid to said rear cavity to flow through said flow passages in said center and said periphery of said divider and into said cavity and along said paint flow surface to said atomizing edge.

4. The rotary atomizer of claim 1 further comprising: support means located within said interior space of said housing for supporting said color changer in positionally adjustable relation along said axis to said second end of said feed tube.

5. The rotary atomizer of claim 4 wherein said support means comprises at least one elongated member spanning at least a portion of said interior space of said housing in a region thereof between said rearward end of said housing and said second end of said feed tube, said member being longitudinally oriented substantially parallel to said axis, said color changer being at least partially supported by said member at a location which is positionally adjustable along said axis.

6. The rotary atomizer of claim 4 wherein said support means comprises a base removably securable to said rearward end of said housing and, a pair of mutually parallel supports spaced from one another and extending generally perpendicularly from said base into said region of interior space, and guide means on said color changer for supporting said color changer between said supports in said positionally adjustable relation with said second end of said feed tube.

7. The rotary atomizer of claim 6 wherein said guide means comprises a recess formed in said body, said recess being of a shape complementary to that of said supports to permit sliding engagement between said body and said supports.

8. The rotary atomizer of claim 5 further comprising releasable locking means engageable with said body and said support means for holding said body in a fixed position along said axis.

9. The rotary atomizer of claim 1 wherein each said valve includes an actuator disposed within said body for selectively opening and closing said valve in accordance with a control input.

10. The rotary atomizer of claim 1 further comprising a fluid pressure regulator located entirely within said interior space of said housing, said regulator including a regulator inlet in fluid communication to said chamber and a regulator outlet in fluid communication with said second end of said feed tube.

11. The rotary atomizer of claim 10 wherein said regulator inlet is connected to said chamber by way of a first conduit and wherein said regulator outlet is connected to said second end of said feed tube by way of a second conduit, said chamber, said first conduit and said second conduit each lying in substantially direct alignment with said axis.

12. The rotary atomizer of claim 1 wherein:

(a) said body of said color changer includes a first face, a mutually opposed second face and a peripheral side between said faces, said body including a plurality of valve bores, each bore penetrating said side and extending only partially through said body along a particular axis, each of said particular axes being directed generally toward a common point, each said bore communicating with a respective said fluid inlet and a respective said fluid outlet formed in said body, said discharge port being connected to each said fluid outlet by way of outlet passages formed in said body, and (b) wherein each of said valves includes:

(i) a valve seat interposed between each said fluid inlet and each said respective fluid outlet;

(ii) a valve member matable with said seat and movable with respect thereto to close the valve when mated with said seat and to open the valve when moved away from said seat; and (iii) an actuator operably connected to at least one of said valve seat and said valve member to effect relative movement therebetween to open and close the valve in accordance with a control input;

said valve seat, valve member and actuator each being disposed substantially entirely within a respective said bore.

13. The rotary atomizer of claim 12 wherein said body is formed of electrically non-conductive material.

14. The rotary atomizer of claim 12 wherein said discharge port intersects said common point.

15. A rotary atomizer comprising:

(a) a housing having a forward end and a rearward end, said housing defining an interior space between said ends;

(b) an atomizing head mounted for rotation about an axis, said atomizing head having a base, an interior cavity bounded by a wall terminating in an atomizing edge and a first bore oriented along said axis through said base, said first bore having an end communicating with said interior cavity, (c) a motor driveably coupled to said atomizing head for rotating said atomizing head about said axis, said motor being disposed inside said housing and having a second bore therethrough, said second bore being aligned with said first bore along said axis, and (d) a feed tube spanning said first and second bores and removably received therein, said feed tube including an internal passage having a first end and an opposed second end, said first end communicating with said interior cavity for conducting fluid thereto;

(e) a valve manifold located entirely within said housing, said manifold including a plurality of valves each having at least a fluid inlet and a fluid outlet formed in a common body, said body further including a discharge port communicating with each said fluid outlet, said discharge port being coupled to said second end of said feed tube, and (c) support means located within said housing for supporting said valve manifold in positionally adjustable relation to said second end of said feed tube when said feed tube is received within said first and second bores.

16. The rotary atomizer of claim 15 wherein said support means comprises at least one member spanning at least a portion of the distance between said first end of said feed tube and said rearward end of said housing, said member having a longitudinal axis oriented substantially parallel to said axis, said valve manifold being at least partially supported by said member at a location which is positionally adjustable along said axis.

17. The rotary atomizer of claim 15 wherein said support means comprises a base removably securable to said rearward end of said housing and, a pair of mutually spaced supports having longitudinal axes extending generally perpendicularly from said base into said interior space, and guide means on said valve manifold for supporting said valve manifold between said supports in a position adjustable along said axes.

18. The rotary atomizer of claim 17 wherein said guide means comprises a recess formed in said body of said valve manifold, said recess being of a shape complementary to that of said supports to permit sliding engagement between said body and said supports.

19. The rotary atomizer of claim 16 further comprising locking means for holding said body in a fixed position with respect to said axis.

20. A rotary atomizer, comprising:

(a) a housing having a forward end and a rearward end and defining an interior space between said ends;

(b) an atomizing head rotatable about an axis, said atomizing head having a coating material flow surface forming a forward cavity, said flow surface terminating in an atomizing edge;

(c) supply means for supplying fluid to said forward cavity, said supply means including a feed tube having a first end communicating with said cavity and a second end, and (d) a fluid pressure regulator located entirely within said interior space of said housing, said regulator including a regulator outlet connected to said second end of said feed tube and a regulator inlet.

21. The rotary atomizer of claim 20 wherein said regulator outlet and said feed tube each lie in substantially direct alignment with said axis.

22. The rotary atomizer of claim 20 further comprising:

a color changer located entirely within said housing, said color changer including a body in which a plurality of valves are at least partially mounted, each of said valves having at least a fluid inlet and a fluid outlet, each said fluid outlet communicating with a common chamber, each said fluid inlet being connectable to a supply of one of a plurality of fluids, said common chamber being in fluid communication with said second end of said feed tube.

23. The rotary atomizer of claim 22 wherein said regulator inlet is connected to said common chamber by way of a first conduit and wherein said regulator outlet is connected to said second end of said feed tube by way of a second conduit, said common chamber, said first conduit and said second conduit each lying in substantially direct axial alignment with said axis.

24. The rotary atomizer of claim 20 wherein said common chamber is in fluid communication with said second end of said feed tube by way of said pressure regulator.

25. The rotary atomizer of claim 20 wherein said atomizing head further includes a rearward cavity and a divider which separates said forward cavity from said rearward cavity, said divider having a central portion and a periphery and paint flow passages through said central portion and through said periphery, and wherein said tube supplies fluid to said rearward cavity to flow through said flow passages in said center and said periphery of said divider and into said forward cavity and along said paint flow surface to said atomizing edge.

26. The rotary atomizer of claim 22 further comprising:

support means located within said interior space of said housing for supporting said color changer in positionally adjustable relation along said axis to said second end of said feed tube to facilitate connecting and disconnecting of said regulator.

27. The rotary atomizer of claim 26 wherein said support means comprises at least one elongated member spanning at least a portion of said interior space of said housing in a region thereof between said rearward end of said housing and said second end of said feed tube, said member being longitudinally oriented substantially parallel to said axis, said color changer being at least partially supported by said member at a location which is positionally adjustable along said axis.

28. The rotary atomizer of claim 26 wherein said support means comprises a base removably securable to said rearward end of said housing and, a pair of mutually parallel supports spaced from one another and extending generally perpendicularly from said base into said region of interior space, and guide means on said color changer for supporting said color changer between said supports in said positionally adjustable relation with said second end of said feed tube.

29. The rotary atomizer of claim 28 wherein said guide means comprises a recess formed in said body, said recess being of a shape complementary to that of said supports to permit sliding engagement between said body and said supports.

30. A rotary atomizer, comprising:

(a) a housing having a forward end and a rearward end, said housing defining an interior space between said ends;

(b) an atomizing head rotatable about an axis, said atomizing head having a coating material flow surface forming a forward cavity, said flow surface terminating in an atomizing edge;

(c) supply means for supplying fluid to said forward cavity, said supply means including a feed tube having a first end in fluid communication with said forward cavity and a second end for receiving the fluid, and (d) a color changer for selectively delivering one of a plurality of fluids to said forward cavity of said atomizing head by way of said feed tube, said color changer including a plurality of valves each having at least a fluid inlet and a fluid outlet, each said fluid outlet communicating with a common chamber, said color changer and said feed tube each lying in substantially direct alignment with said axis, each said fluids, said common chamber being in fluid communication with said second end of said feed tube.

31. The rotary atomizer of claim 30 further comprising:

support means located within said interior space of said housing for supporting said color changer in positionally adjustable relation along said axis to said second end of said feed tube.

32. The rotary atomizer of claim 30 wherein said atomizing head further includes a rearward cavity and a divider which separates said forward cavity from said rearward cavity, said divider having a central portion and a periphery and paint flow passages through said central portion and through said periphery, and wherein said tube supplies fluid to said rearward cavity to flow through said flow passages in said center and said periphery of said divider and into said forward cavity and along said paint flow surface to said atomizing edge.

33. The rotary atomizer of claim 30 further comprising a fluid pressure regulator located entirely within said interior space of said housing, said regulator including a regulator inlet in fluid communication with said chamber and a regulator outlet in fluid communication with said second end of said feed tube.

34. The rotary atomizer of claim 33 wherein said regulator inlet is connected to said chamber by way of a first conduit and wherein said regulator outlet is connected to said second end of said feed tube by way of a second conduit, said chamber, said first conduit and said second conduit each lying in substantially direct alignment with said axis.

35. A rotary atomizer, comprising:

(a) a housing having a forward end and a rearward end and defining an interior space between said ends;

(b) a atomizing head rotatable about an axis, said atomizing head having a coating material flow surface forming a forward cavity, said flow surface terminating in an atomizing edge;

(c) supply means for supplying fluid to said forward cavity, said supply means including a tube having a first end communicating with said forward cavity, and a second end for receiving the fluid, and (d) a fluid pressure regulator housing having a regulator outlet in fluid communication with said second end of said feed tube and a regulator inlet receiving a supply of fluid, said regulator outlet and said feed tube each lying in substantially direct alignment with said axis.

36. The rotary atomizer of claim 35 further comprising:

a color changer including a plurality of valves each having at least a fluid inlet and a fluid outlet, each said fluid outlet communicating with a common chamber, each said fluid inlet being connectable to a supply of one of said fluids, said common chamber being in fluid communication with said second end of said feed tube.

37. The rotary atomizer of claim 36 wherein said regulator inlet is connected to said common chamber by way of a first conduit and wherein said regulator outlet is connected to said second end of said feed tube by way of a second conduit, said common chamber, said first conduit and said second conduit each lying in substantially direct axial alignment with said axis.

38. The rotary atomizer of claim 35 wherein said atomizing head further includes a rearward cavity and a divider which separates said forward cavity from said rearward cavity, said divider having a central portion and a periphery and paint flow passages through said central portion and through said periphery, and wherein said tube supplies fluid to said rearward cavity to low through said flow passages in said center and said periphery at said divider and into said forward cavity and along said paint flow surface to said atomizing edge.

39. A rotary atomizer, comprising:

(a) a housing having a forward end and a rearward end, said housing defining an interior space between said ends;

(b) an atomizing head rotatable about an axis, said atomizing head having a coating material flow surface forming a forward cavity, said flow surface terminating in an atomizing edge;

(c) supply means for supplying fluid to said forward cavity, said supply means including a feed tube having a first end in fluid communication with said forward cavity and a second end, and (d) a color changer located entirely within said housing, said color changer including a discharge port for selectively delivering one of a plurality of fluids to said forward cavity of said atomizing head by way of said feed tube, said color changer including a body in which a plurality of valves are at least partially mounted, each of said valves having at least a fluid inlet and a fluid outlet, said said fluid outlet communicating with a common chamber, each said fluid inlet being connectable to a supply of one of said fluids, said common chamber being in fluid communication with said second end of said feed tube by way of said discharge port, the entirety of said common chamber being interposed between said second end of said feed tube and the respective fluid outlets of each of said plurality of valves whereby, substantially the entirety of said common chamber as well as said feed tube can be flushed with the entirety of a flow of solvent flowed into the inlet and out of the outlet of any one of said plurality of valves.

40. A rotary atomizer, comprising:

(a) a portable housing having a forward end and a rearward end and defining an interior space between said ends;

(b) an atomizing head rotatable about an axis, said atomizing head having a coating material flow surface forming a forward cavity, said flow surface terminating in an atomizing edge located exteriorly of said housing;

(c) rotary drive means located within said interior space and coupled to said atomizing head for rotating said atomizing head about said axis;

(d) supply means for supplying fluid to said forward cavity, said supply means including a feed tube having a first end communicating with said cavity and a second end, and (e) a fluid pressure regulator located entirely within said interior space of said housing, said regulator including both a regulator outlet connected to said second end of said feed tube and a regulator inlet.

* * * * *